US009518447B2

(12) United States Patent
Hallundbæk

(10) Patent No.: US 9,518,447 B2
(45) Date of Patent: Dec. 13, 2016

(54) METHOD OF CONTROLLING A DOWNHOLE OPERATION

(71) Applicant: WELLTEC A/S, Allerød (DK)

(72) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 14/362,196

(22) PCT Filed: Dec. 14, 2012

(86) PCT No.: PCT/EP2012/075511
§ 371 (c)(1),
(2) Date: Jun. 2, 2014

(87) PCT Pub. No.: WO2013/087825
PCT Pub. Date: Jun. 20, 2013

(65) Prior Publication Data

US 2014/0352950 A1 Dec. 4, 2014

(30) Foreign Application Priority Data

Dec. 16, 2011 (EP) ..... 11194035

(51) Int. Cl.
*E21B 7/24* (2006.01)
*E21B 41/00* (2006.01)
(Continued)

(52) U.S. Cl.
CPC ..... *E21B 41/00* (2013.01); *E21B 44/005* (2013.01); *E21B 47/01* (2013.01); *E21B 2023/008* (2013.01)

(58) Field of Classification Search
CPC ..... E21B 7/24; E21B 10/38; E21B 28/00; E21B 47/12
(Continued)

(56) References Cited

U.S. PATENT DOCUMENTS 3,626,482 A 12/1971 Quichaud et al.
6,712,160 B1 * 3/2004 Schultz ..... E21B 12/02 166/250.01
(Continued)

FOREIGN PATENT DOCUMENTS

CN 1391632 A 1/2003
CN 101223335 A 7/2008
(Continued)

OTHER PUBLICATIONS

International Search Report for PCT/EP2012/075511 mailed May 31, 2013.
(Continued)

*Primary Examiner* — Doug Hutton, Jr.
*Assistant Examiner* — Ashish Varma
(74) *Attorney, Agent, or Firm* — Nixon & Vanderhye P.C.

(57) ABSTRACT

The present invention relates to a method for controlling a drilling or cutting operation performed by a wireline tool downhole, comprising the steps of commencing a drilling or cutting operation in a downhole object, such as a casing or valve; detecting vibration produced during the drilling or cutting operation in the downhole object using a vibration sensor adapted to transmit detected vibrations; processing a vibration signal from the vibration sensor to produce a real-time frequency spectrum; comparing the frequency spectrum to a reference frequency spectrum; and controlling the operation based upon the comparison of the frequency spectrum and the frequency spectrum specification. Furthermore, the present invention relates to a wireline tool for performing a drilling or cutting operation downhole and carrying out the method according to the invention.

13 Claims, 8 Drawing Sheets

(51) Int. Cl.
*E21B 44/00* (2006.01)
*E21B 47/01* (2012.01)
*E21B 23/00* (2006.01)

(58) Field of Classification Search
USPC ..... 166/250.01
See application file for complete search history.

(56) References Cited

U.S. PATENT DOCUMENTS

| | | | | |
|---|---|---|---|---|
| 2006/0219438 | A1* | 10/2006 | Moore | E21B 47/122 175/50 |
| 2007/0251687 | A1 | 11/2007 | Martinez et al. | |
| 2009/0250210 | A1* | 10/2009 | Allen | E21B 43/128 166/250.15 |
| 2012/0027630 | A1 | 2/2012 | Forsberg et al. | |

FOREIGN PATENT DOCUMENTS

| | | |
|---|---|---|
| GB | 2 275 283 | 8/1994 |
| WO | WO 02/35048 | 5/2002 |
| WO | WO 2010/054353 | 5/2010 |

OTHER PUBLICATIONS

International Preliminary Report on Patentability for PCT/EP2012/075511, mailed Mar. 6, 2014.
Chinese Office Action mailed Jun. 21, 2016 in Chinese Application No. 201280058694.3, with English translation (10 pages).

* cited by examiner

METHOD OF CONTROLLING A DOWNHOLE OPERATION

This application is the U.S. national phase of International Application No. PCT/EP2012/075511, filed on 14 Dec. 2012, which designated the U.S. and claims priority to EP Application No. 11194035.9, filed on 16 Dec. 2011, the entire contents of each of which are hereby incorporated by reference.

FIELD OF THE INVENTION

The present invention relates to a method for controlling a drilling or cutting operation performed by a wireline tool downhole. Furthermore, the present invention relates to a wireline tool for performing a drilling or cutting operation downhole and carrying out the method according to the invention.

BACKGROUND ART

When performing drilling or cutting operations downhole, it is desirable to be able to monitor and control the drilling or cutting process. However, in practice, this is difficult to achieve for several reasons. Firstly, it is difficult to know the exact position of a drill bit or cutting blade in the well and thus to determine exactly which part of the casing is being cut or drilled. Secondly, the drilling or cutting process cannot be visually inspected, and it is difficult to determine whether the machinery is operating properly based on known techniques. Furthermore, the specifications, composition or state of the component to be drilled in downhole may not always be known, or may prove to be different than expected, and may therefore not be as easy to drill into as expected. It would therefore be advantageous to be able to determine whether the correct weight on bit and drill bit rotary speed is applied and/or to monitor whether the drilling or cutting process proceeds as planned and whether unforeseen conditions occur.

SUMMARY OF THE INVENTION

It is an object of the present invention to wholly or partly overcome the above disadvantages and drawbacks of the prior art. More specifically, it is an object to provide an improved method for controlling drilling or cutting operations downhole, wherein the drilling or cutting process is monitored.

The above objects, together with numerous other objects, advantages, and features, which will become evident from the below description, are accomplished by a solution in accordance with the present invention by a method for controlling a drilling or cutting operation performed by a wireline tool downhole, comprising the steps of:

- commencing a drilling or cutting operation in a downhole object, such as a casing or valve,
- detecting vibrations in a tool housing produced during the drilling or cutting operation in the downhole object using a vibration sensor being an accelerometer arranged on the tool housing,
- processing a vibration signal from the vibration sensor to produce a reference frequency spectrum in a first part of the drilling or cutting operation,
- processing a vibration signal from the vibration sensor to produce a real-time frequency spectrum,
- comparing the frequency spectrum to the reference frequency spectrum,

- calculating and detecting a completion or failure of the operation, such as a completion in which the casing has been cut into two casing sections or a failure in which the bit is stuck, based on the comparison of the real-time frequency spectrum and the reference frequency spectrum, and controlling the operation to terminate the operation when completion or failure of the operation has been detected.

By producing a reference frequency spectrum during the first part of the drilling or cutting operation, a reference is made without measuring a large amount of different casings and casing parts to create a database of all imaginable types of casings and casing parts. The casings are different, not only in terms of dimensions and material but also in relation to the different components assembled for creating the casing string. The components vary in function and dimension, and the number of components and casing sections varies from one well to the other. Thus, developing a reference database is very time-consuming, and there is still no guarantee that it contains a usable reference. Therefore, producing the reference during the first part of the drilling or cutting operation when the start-up phase is over provides for a very simple reference, and the operation does not even need to stop while running. Furthermore, in this way, the reference is very precise as it is not produced in a casing part varying in dimension and material. When the dimension or material of the casing varies, the Eigen frequency varies too, meaning that the detected vibrations vary as well.

In an embodiment, the step of calculating and detecting a completion of the operation may comprise a step of calculating a centre of gravity of oscillation of an area of peaks in the frequency spectrum, which area is above a certain value and comparing that centre of gravity with a centre of gravity of an area of peaks in the reference frequency spectrum, which area is above the same certain value to determine a discrepancy between the two centres of gravity, and the step of controlling the operation may be based on the centre of gravity comparison.

Furthermore, the certain value may be an amplitude of more than 40, preferably more than 50, and even more preferably more than 60.

In another embodiment, the step of processing a vibration signal from the vibration sensor to produce a reference frequency spectrum may be performed in the first part of the drilling or cutting operation when a start-up phase has ended.

By determining a discrepancy between the reference frequency spectrum and the real-time frequency spectrum, the drilling or cutting operation is continuously monitored whereby it is possible to control or adjust the drilling or cutting process continuously.

The method as described above may further comprise a step of determining a discrepancy between the reference frequency spectrum and the real-time frequency spectrum before the step of controlling.

Also, said method may comprise the step of terminating the drilling or cutting operation in the downhole object if the discrepancy is above a predetermined threshold value.

Hereby, the drilling or cutting process may be automatically stopped to avoid tool breakdown and excessive wear of tools.

Moreover, the method according to the present invention may further comprise the step of inferring that the downhole object is being drilled or cut when the discrepancy between a reference frequency spectrum and the real-time frequency spectrum is above or below a predetermined threshold value.

Hereby, the exact position of the drill bit or cutting blade relative to the object being drilled may be determined.

When the cutting operation ends and the casing is almost cut through, the operator may want to slow down the cutting speed, and receiving a signal that the discrepancy is above or below a predetermined threshold value enables the operator to predict the end and thus regulate the drill bit rotary speed and weight on bit.

Further, the method as described above may comprise a step of sending a signal uphole that the operation has been performed according to plan.

Additionally, said method may comprise the step of controlling the drill bit rotary speed and weight on bit based on the discrepancy between a reference frequency spectrum and the real-time frequency spectrum.

Hereby, the drilling or cutting operation may be optimised, and excessive wear of the drill bit or cutting blade may be avoided.

Moreover, the method according to the present invention may further comprise the step of detecting a change in the discrepancy between a reference frequency spectrum and a real-time frequency spectrum indicative of the casing wall having been completely drilled or cut through.

Hereby, it may be determined when the drilling or cutting process is completed.

Furthermore, the discrepancy between the reference frequency spectrum and the real-time frequency spectrum may be determined by evaluating whether a vibration signal within one or more reference frequency bands is higher or lower than a predetermined threshold level.

In addition, the discrepancy between the reference frequency spectrum and the real-time frequency spectrum may be determined by evaluating whether at least one vibration signal within a higher frequency band and at least one vibration signal within lower frequency band are simultaneously higher or lower than respective predetermined threshold levels.

In one embodiment, the lower frequency band may be in a first frequency range of 500 Hz-5 KHz.

In another embodiment, the higher frequency band may be in a second frequency range of 5 KHz-50 KHz.

Moreover, the discrepancy between the reference frequency spectrum and the real-time frequency spectrum may be determined using a numerical process.

The present invention also relates to a wireline tool for performing a drilling or cutting operation downhole and carrying out the method as described above, comprising:

a tool housing having an inner face, a drill bit or cutting bit, a means for advancing the drill bit or cutting bit, a rotation means for rotating the drill bit or cutting bit, and one or more vibration sensors adapted to transmit detected vibrations produced during operation of the wireline drilling or cutting tool;

wherein the one or more vibration sensors is/are accelerometer(s) arranged in such a way that it/they contact(s) the inner face of the tool casing and adapted to detect vibrations in the tool housing transmitting vibrations produced during operation of the wireline drilling or cutting tool to the one or more sensors, and wherein the wireline tool further comprises a processing unit for processing a vibration signal from the vibration sensor to produce a real-time frequency spectrum, and for comparing the frequency spectrum to a reference frequency spectrum.

In one embodiment, the one or more vibration sensors may be arranged in an end of the tool furthest away from the drill bit or cutting bit.

Having an accelerometer allows the vibration sensors to be arranged furthest away from the bit and thus closest to the wireline or fibre cable sending the information to surface.

In another embodiment, the vibration sensors may be arranged along a circumference of the inner face.

In yet another embodiment, the processor may comprise a signalling filter in the frequency range of 1-200 KHz.

Furthermore, the tool may comprise an array of vibration sensors arranged along the inner face.

Said means for advancing the drill bit or cutting bit may be a downhole tractor.

The tool may further comprise a centraliser for centralising the tool in the casing.

Moreover, the tool may further comprise an anchor section for anchoring the tool in the casing.

Further, the vibration sensor may be adapted to detect vibrations generated in the drill bit during drilling operations.

In one embodiment, a plurality, preferably two and most preferably three, vibration sensors may be used for detecting vibrations of different frequency bands.

By means of the wireline tool it is possible to detect excessive drill bit wear based on the levels of the at least one vibration signal within a higher frequency band and the at least one vibration signal within a lower frequency band.

Furthermore, the drilling or cutting operation may have the purpose of drilling or cutting through a casing, drilling a defect valve, or drilling through an obstruction in the fluid path.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
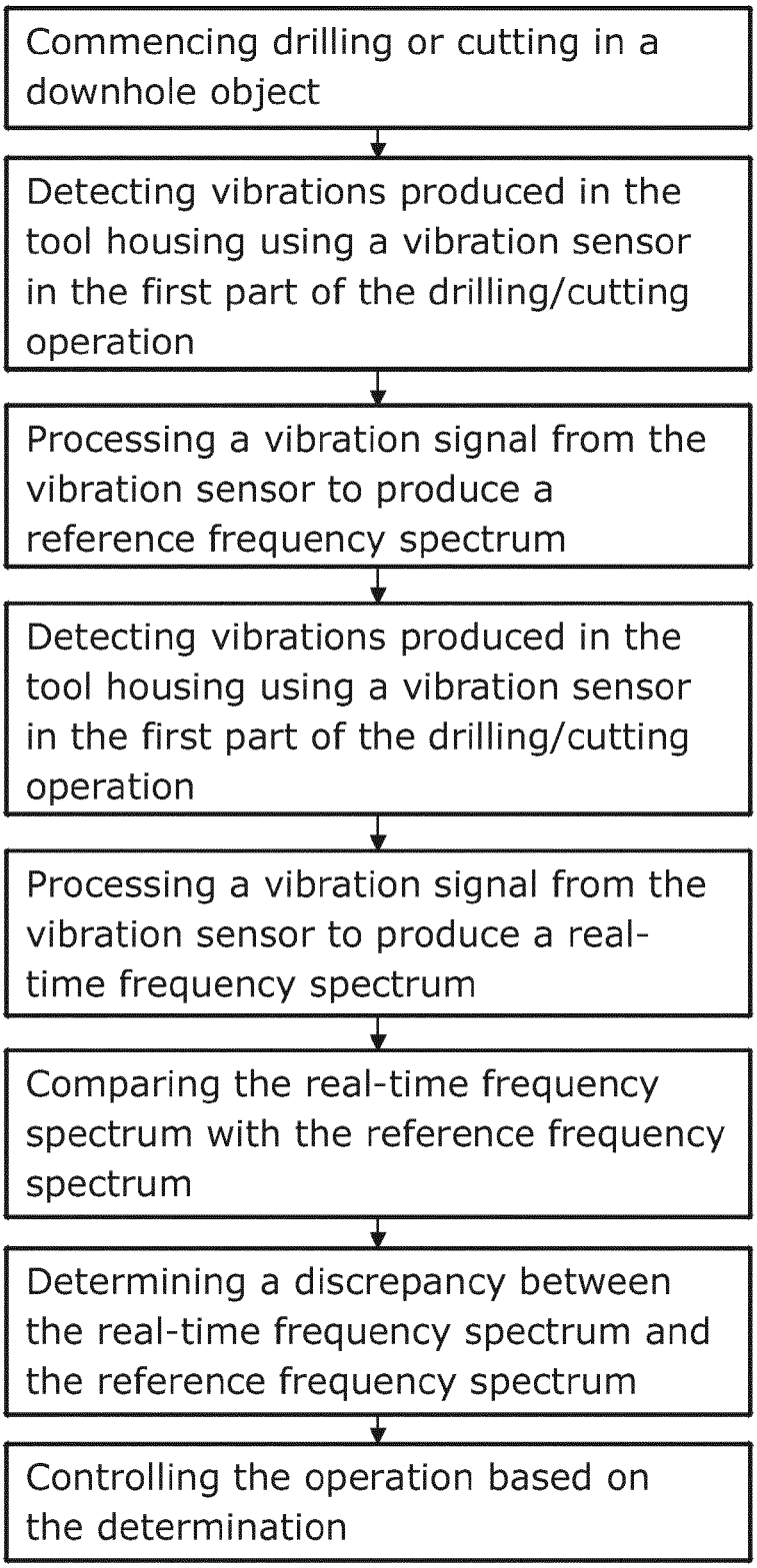
FIG. 1 shows a flowchart of the method for controlling a drilling or cutting operation.
Figure 2A:
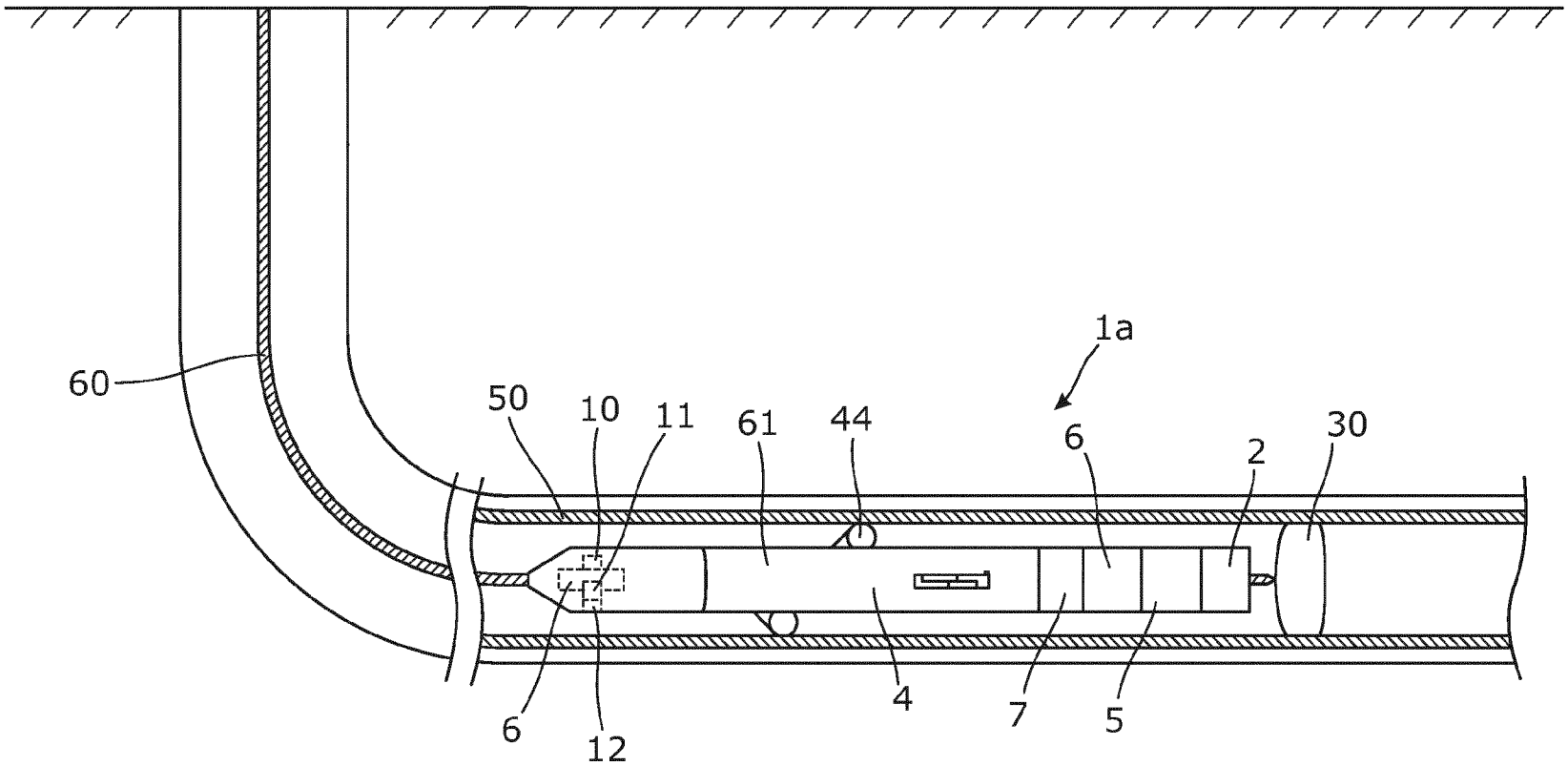
FIG. 2*a* shows a wireline drilling tool for performing a drilling operation downhole.
Figure 2B:
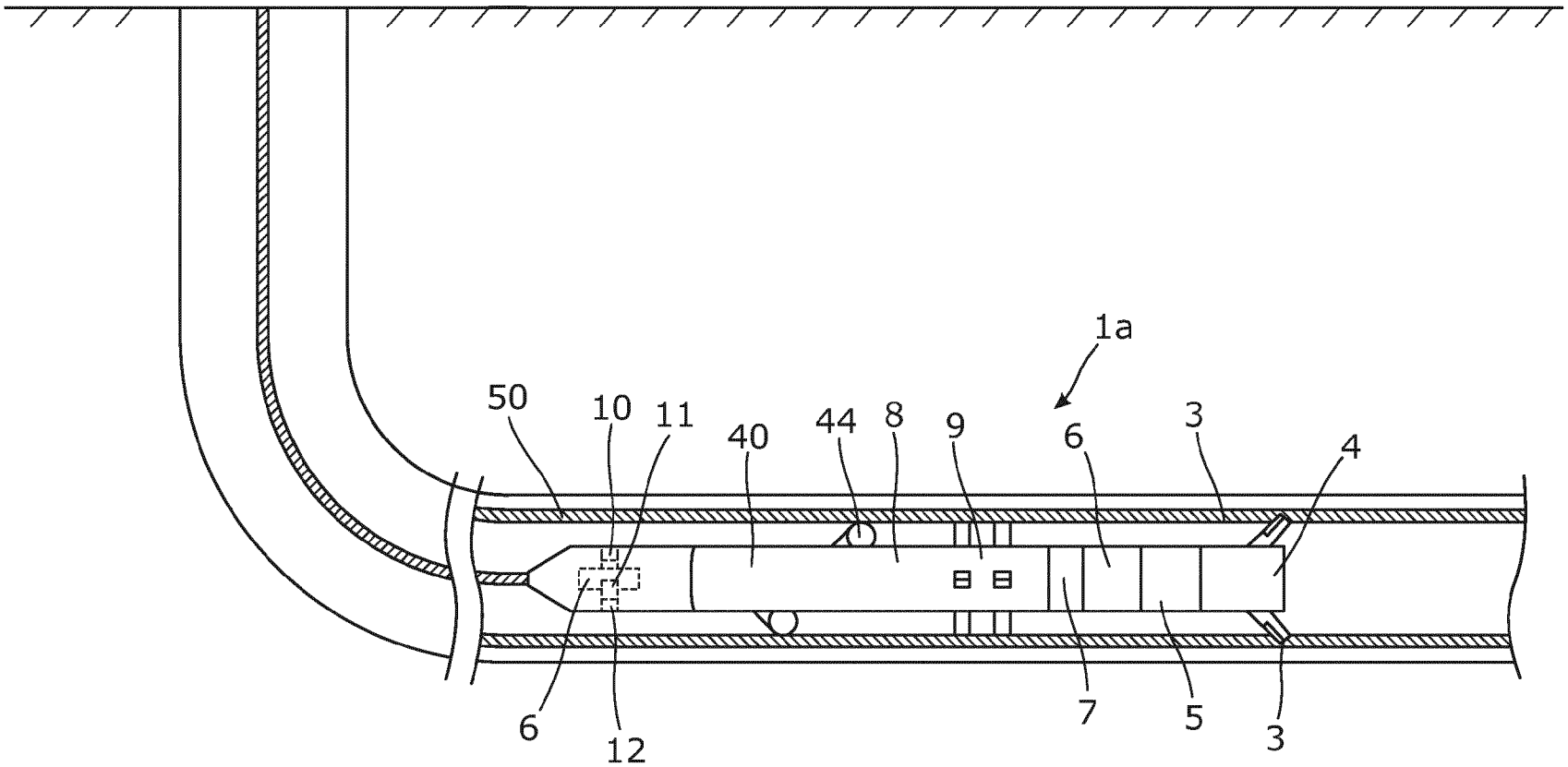
FIG. 2*b* shows a wireline cutting tool for performing cutting operations downhole.

FIG. 1 shows a flowchart of a method for controlling a drilling or cutting operation downhole. Such a method may be performed downhole by a wireline drilling tool for perforating a casing 50 of a well or for drilling out a clogged valve 30, as shown in FIG. 2*a*. The method may also be performed downhole by a wireline cutting tool for severing the casing 50 of a well or for otherwise cutting a casing 50, as shown in FIG. 2*b*. In the following, the wireline drilling tool and the wireline cutting tool will be denoted collectively as the wireline tool.

When the wireline tool has been lowered into the well and positioned appropriately, the drilling or cutting process is commenced as the first step in the flowchart. When the rotating drill bit or cutting blade engages the object being drilled in, such as the casing 50, as shown in FIG. 3*b*, or the valve 30, as shown in FIG. 3*a*, vibrations will occur in both the object and the wireline tool itself.

The vibrations generated by the drilling or cutting action are detected by a vibration sensor 10, 11, 12 being an accelerometer arranged in such a way that it contacts an inner face of the tool housing of the wireline tool, and the vibrations are subsequently transmitted as vibration signals to a processing unit 6, as shown in FIGS. 2*a* and 2*b*. The processing unit may be positioned in the wireline tool or outside the well, e.g. at the top of the well. During the first part of the drilling or cutting operation, the vibrations generated when the start-up phase has ended are detected by the vibration sensor, and a reference frequency spectrum is produced by means of the processing unit. The processing unit then processes the vibration signals to record a real-time frequency spectrum 21 of the vibrations present, as shown in FIG. 1*b*.

Figure 1A:
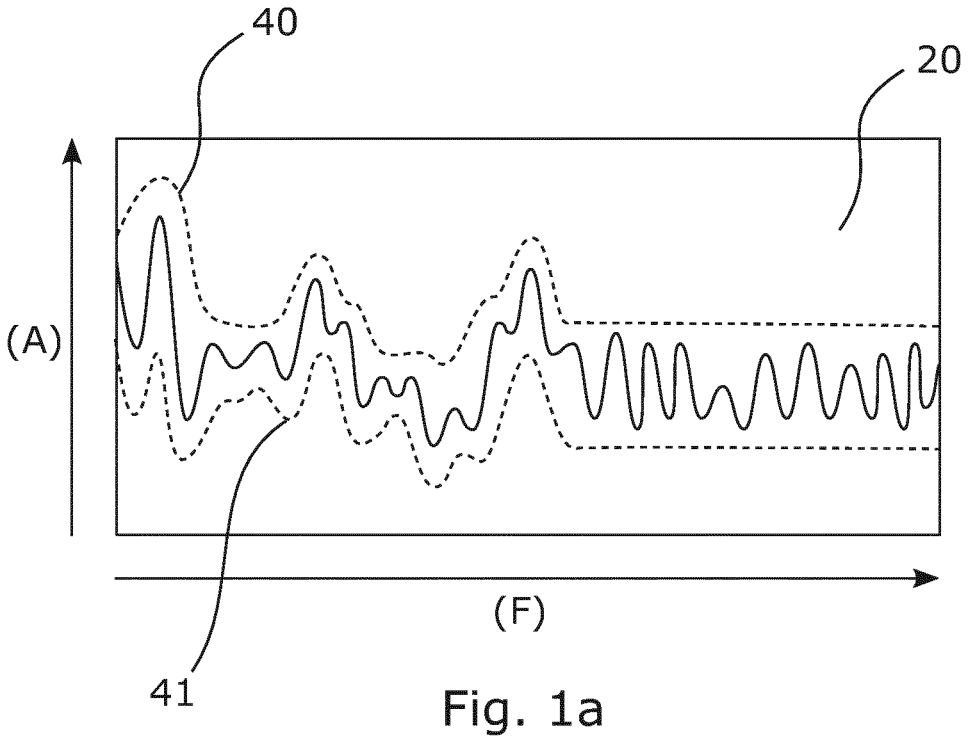
FIG. 1*a* shows a schematic diagram of a reference frequency spectrum.
Figure 1B:
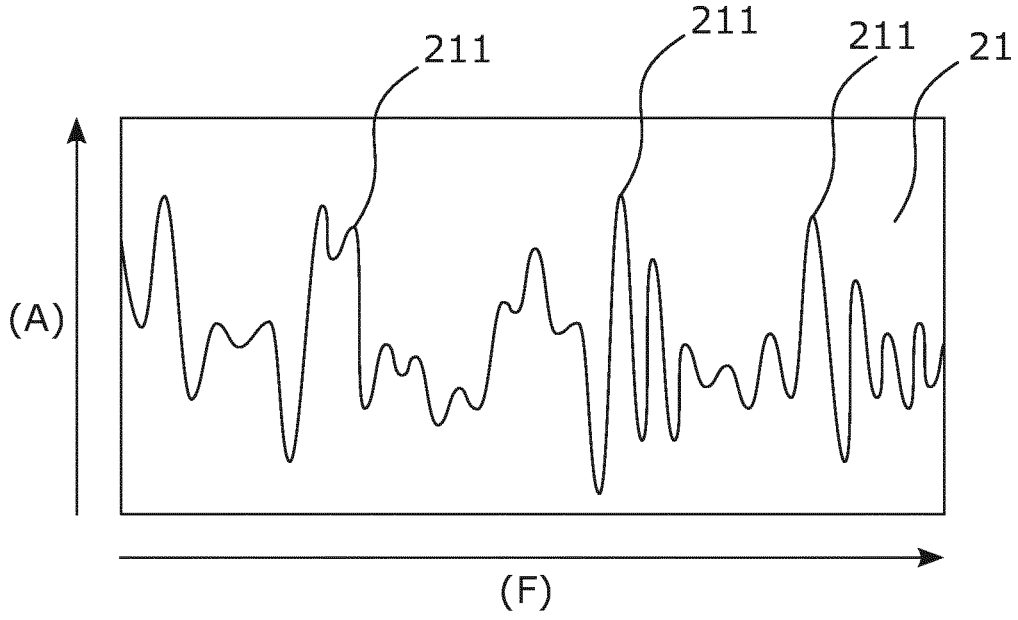
FIG. 1*b* shows a schematic diagram of a real-time frequency spectrum.

The processed frequency spectrum is then compared with a reference frequency spectrum 20, as shown in FIG. 1*a*, and the reference frequency spectrum is subsequently linked to intervals of maximum and minimum acceptable frequency values at any time during the operation. These intervals are illustrated as dotted lines in FIG. 1*a* by a maximum 40 and a minimum 41. By comparing the detected and processed frequency spectrum with the reference frequency spectrum, the operation can be controlled at any stage if the detected vibrations fall outside the expected interval.

When drilling or cutting in an object or in the casing downhole, the drilling bit or power available may be inadequate to perform the operation, for which reason the operation needs to be stopped before the drilling bit gets stuck or the casing is damaged unnecessarily. If the operation cannot be performed, this may be detected by continuously detecting the real-time frequency spectrum and comparing it with the reference frequency spectrum.

After processing a real-time frequency spectrum based on the detected vibrations, a discrepancy between the reference frequency spectrum and the real-time frequency spectrum may be determined, and based on this discrepancy, the drilling or cutting operation may be controlled. If the discrepancy is acceptable, i.e. if the real-time frequency spectrum is within the acceptable intervals of the reference frequency spectrum, the operation continues without any changes. If the discrepancy is too extensive, i.e. if the real-time frequency spectrum is outside the acceptable intervals of the reference frequency spectrum, the operation is either stopped or the operation parameters are changed.

The detecting of vibrations may be performed continuously or at predetermined intervals. Further, if the discrepancy increases or the operation parameters have been changed, vibrations may be detected more frequently or continuously. When the operation parameters have changed, a new reference frequency spectrum is processed as the vibrations changes accordingly.

When the operation has been performed within the intervals of the reference frequency spectrum, the tool sends a signal to surface, e.g. to a computer, that the operation runs according to the reference frequency spectrum. Such signals are sent at predetermined intervals to indicate to the operator and/or the client ordering the operation that the operation is proceeding according to plan. When performing downhole operations, safety is very important to prevent blowout incidents or other critical situations. Especially operations providing openings or holes in the casing or in objects, such as a valve, are under restricted surveillance due to the potential hazard of such operations. After much talk-about the massive oil spill in the Mexican Gulf in 2010, there has been an increasing demand for systems allowing for signals to be sent to surface, even when the operation is running according to plan, to calm the client or the operator.

In the processing unit, the vibrations signals may be sent through an amplification stage wherein the vibration signals are amplified. The vibration signals may also be converted from analog to digital signals by an analog-to-digital converter (ADC). Following the amplification stage, the vibration signals may be sent through one or more frequency filters. The accuracy of the frequency analysis is dependent on the bandwidths of these filters, and thus the smaller the bandwidth, the higher the accuracy of the achieved analysis.

During the drilling or cutting process, the real-time frequency spectrum 21 is detected continuously or quasi-continuously, or at predetermined points in time during the process. The real-time frequency spectrum 21 is detected over a predetermined frequency range dependent on the specific characteristics of the drilling or cutting process. The frequency range of the frequency spectrum may be in the range of 100 Hz-200 KHz. However, as drilling operations are often carried out using relatively low drill bit rotary speeds, a frequency range of 100 Hz-50 KHz is sufficient in most cases. The frequency range may also be dependent on the material of the object to be drilled in or cut.

The frequency spectrum is detected with the coordinates of frequency (F), and amplitude (A) or as a function of time (T).

In FIG. 1*b*, the real-time frequency spectrum 21 is illustrated as a graph plotting the amplitude (A) of the vibrations versus frequency (F). However, the frequency spectrum may be presented in a number of other ways known to the skilled person. It is not necessary to plot or imaginarily create a graph to compare the processed detected vibration signals. Each measurement detected by the sensor may be processed and compared with the reference frequency spectrum to be within or outside the acceptable intervals given therein. For example, to evaluate the course of a drilling or cutting process, the amplitude versus time may be plotted for a specific frequency band by means of the processing unit. In this way, it is possible to follow the development within a specific frequency range over time. The frequency spectrum may also be illustrated in a three-dimensional coordinate system plotting frequency, time and amplitude, in which frequency and time span/define a plane, and a height profile of that plane in the coordinate system is defined by the magnitude of the amplitude.

The real-time frequency spectrum 21 is evaluated to monitor the drilling or cutting process, whereby the drilling or cutting operation may be controlled dependent on specific conditions. The evaluation may be done continuously or quasi-continuously, or may be conducted at predetermined points in time during the process, e.g. when the process enters a new phase. Preferably, evaluation is carried out in real-time.

The real-time frequency spectrums are evaluated by determining a discrepancy 211 between a reference frequency spectrum 20, as shown in FIG. 1*a*, and the real-time frequency spectrum 21 to be evaluated. Preferably, the evaluation process is carried out in an automated manner.

As mentioned the reference frequency spectrum also called the frequency spectrum specifications may also be recorded during the drilling or cutting process being evaluated. For example, if the purpose of a cutting process is to sever or cut the casing, frequency spectrum specifications may be recorded at predetermined points in time during the operation, e.g. 2-6 times during the cutting operation. The recorded frequency spectrum specifications may then be compared with the real-time frequency spectrum to determine when the casing has been cut through. The comparison of frequency spectrum specifications and real-time frequency spectrums may also be combined with time measurements to determine when the casing has been cut through.

The evaluation process may also be based on sample recognition. Algorithms suitable for multi-dimensional, in particular three-dimensional, sample recognition may be used by implementing such algorithms in a computer having real-time access to detected frequency spectrums or access to stored frequency spectrums.

Further, in the evaluation of the real-time frequency spectrums, focus may be on specific frequency bands by detecting whether a vibration signal within one or more predetermined frequency bands is higher or lower than specific predetermined threshold levels. The discrepancy between the reference frequency spectrum 20 and the real-time frequency spectrum 21 may also be determined by evaluating whether at least one vibration signal within a higher frequency band and at least one vibration signal within a lower frequency band are simultaneously higher than respective predetermined threshold levels.

The recorded real-time frequency spectrums may be subject to an analysis in a computer either in the tool downhole or at the surface. Further, the detected real-time frequency spectrums may be stored in a memory of the drilling or cutting tool or transmitted to the surface before being stored.

If a certain discrepancy is detected between the real-time frequency spectrum 21 and the reference frequency spectrum, the drilling or cutting process may be stopped and/or control actions may be initiated. If the control actions result in a change in the real-time frequency spectrum 21 towards the reference frequency spectrum 20, the drilling or cutting process may be continued, otherwise the process may be permanently terminated.

Figure 1C:
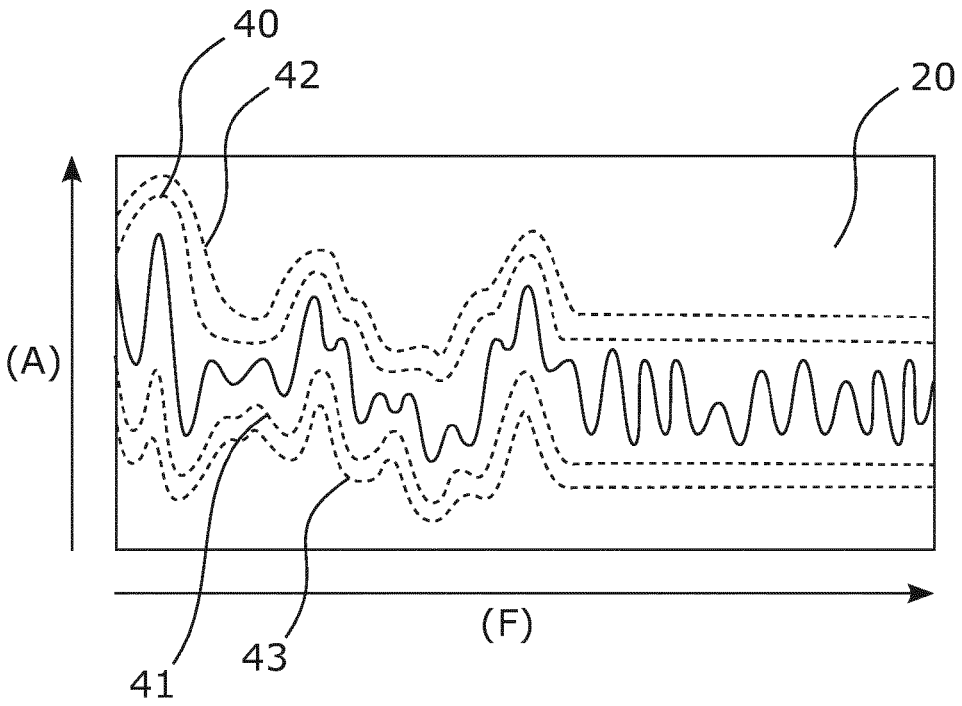
FIG. 1*c* shows a schematic diagram of another reference frequency spectrum.

In FIG. 1*c*, second intervals have been incorporated into the reference frequency spectrum. The second intervals are illustrated by a dotted line 42 above the maximum dotted line 40 indicating when to stop the operation immediately and a dotted line 43 below the minimum dotted line 41 which may also indicate when to stop the operation and e.g. change bit or change the operation parameters. The control actions may be activated when the processed signal is between the maximum and minimum intervals while the operation continues. If required, e.g. by the client, a signal may be sent to surface that a control action has been initiated. When the control action has been initiated, a signal is sent to the sensors to detect the vibrations more frequently, if the detecting is not performed continuously already.

The detection of discrepancies may be performed in an automated manner by a computer or by a human operator. The human operator may be positioned at a rig at the surface or in a location remote from the well. If a discrepancy is detected by a computer, control actions may be initiated in an automated manner based on a predetermined guideline. The computer may also automatically shut down the cutting or drilling operation if the discrepancy is too high.

The detection of discrepancies between the real-time frequency spectrum 21 and the reference frequency spectrum 20 may have many uses. For example, it may be inferred that excessive drill bit wear is taking place or that the drill bit has been worn down. It may also be used to adjust the drill bit rotary speed and weight on bit or to infer the material being drilled in. Also, wear on the drill bit may be determined to assess when a drill bit should be changed in order to optimise the drilling process. Changes in the real-time frequency spectrum 21 may be indicative of a downhole object being drilled, or that the casing 50 wall has been completely drilled or cut through. Further, by detecting changes and discrepancies continuously, serious defects may be avoided, such as tool breakdown, excessive wear of tools, destruction of casing or valves, etc.

Figure 3:
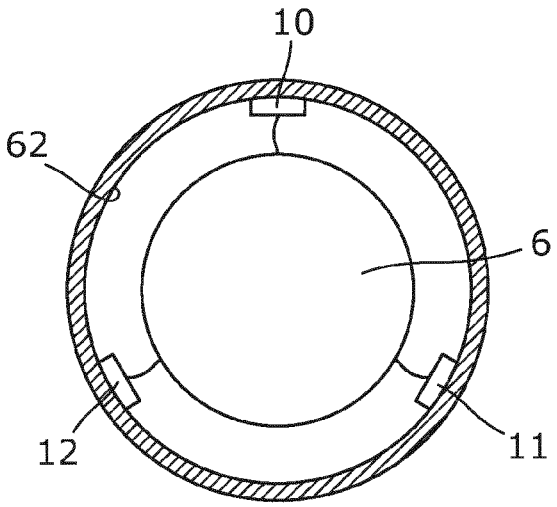
FIG. 3 shows a cross-sectional view of the tool illustrating the arrangement of the vibration sensors.

FIG. 2*a* shows a wireline drilling tool 1*a* suspended inside a casing 50 downhole, comprising a drill bit 2, means for advancing the drill bit 4 and controlling weight on the drill bit, rotation means for rotating 5 the drill bit and controlling drill bit rotary speed and one or more vibration sensors 10, 11, 12 adapted to transmit detected vibrations produced during operation of the wireline drilling tool. The one or more vibrations sensors is/are arranged in an end of the tool opposite the end of the drill bit and is/are arranged inside the wireline tool on the inner face of the tool housing, as shown in FIG. 3. In this way, the tool housing transmits the vibrations to the accelerometers detecting the vibrations, and the processing unit inside the tool is able to process the information of the accelerometers and send a signal to the top of the well through the wireline 60 shown in FIG. 2*a*. In the wireline drilling tool 1*a* shown in FIG. 2*a*, the means 4 for advancing the drill bit is a downhole tractor 4 providing a forward motion by means of multiple driving wheels 41 extending towards the side of the casing 50. The downhole tractor also functions as a centraliser 61. The wheels may be driven by a hydraulic system and provide the necessary traction to provide weight on bit. The means 4 for advancing the drill bit may, however, also be a piston arrangement, such as a hydraulic piston. The downhole tractor 4 may also be used for other purposes, such as for driving the wireline cutting tool forward in inclining sections of the well.

FIG. 2*b* shows a wireline cutting tool 1*b* suspended inside a casing 50 downhole, comprising a cutting blade 3, means 4 for advancing the cutting blade, rotation means 5 for rotating the cutting blade and controlling cutting blade rotary speed and one or more vibration sensors 10, 11, 12 being accelerometers adapted to detect vibrations produced during operation of the wireline drilling tool. The one or more vibrations sensors is/are arranged in such a way that it/they is/are in contact with the chassis or the tool housing at the end closest to the top of the well and furthest away from the cutting bit. Further, the wireline cutting tool 1*b* may comprise an anchoring section 9 for anchoring the wireline cutting tool in the well and/or a downhole tractor 8 for driving the wireline cutting tool forward in inclining sections of the well.

Figure 4A:
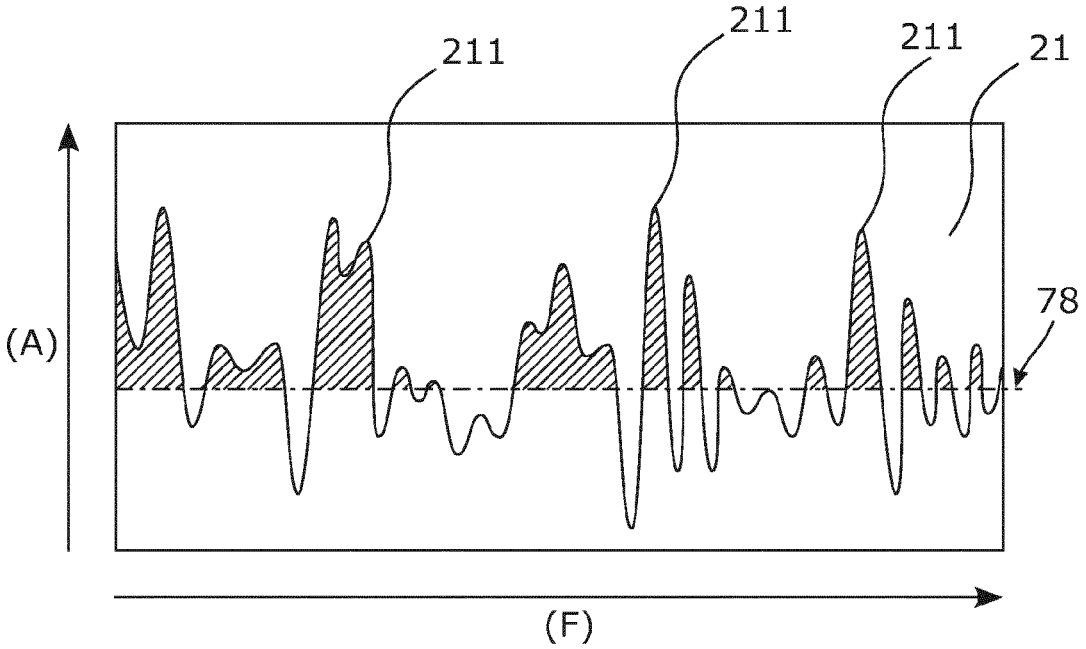
FIG. 4*a* shows a schematic diagram of frequency spectrum for calculation of gravity of oscillation.
Figure 4B:
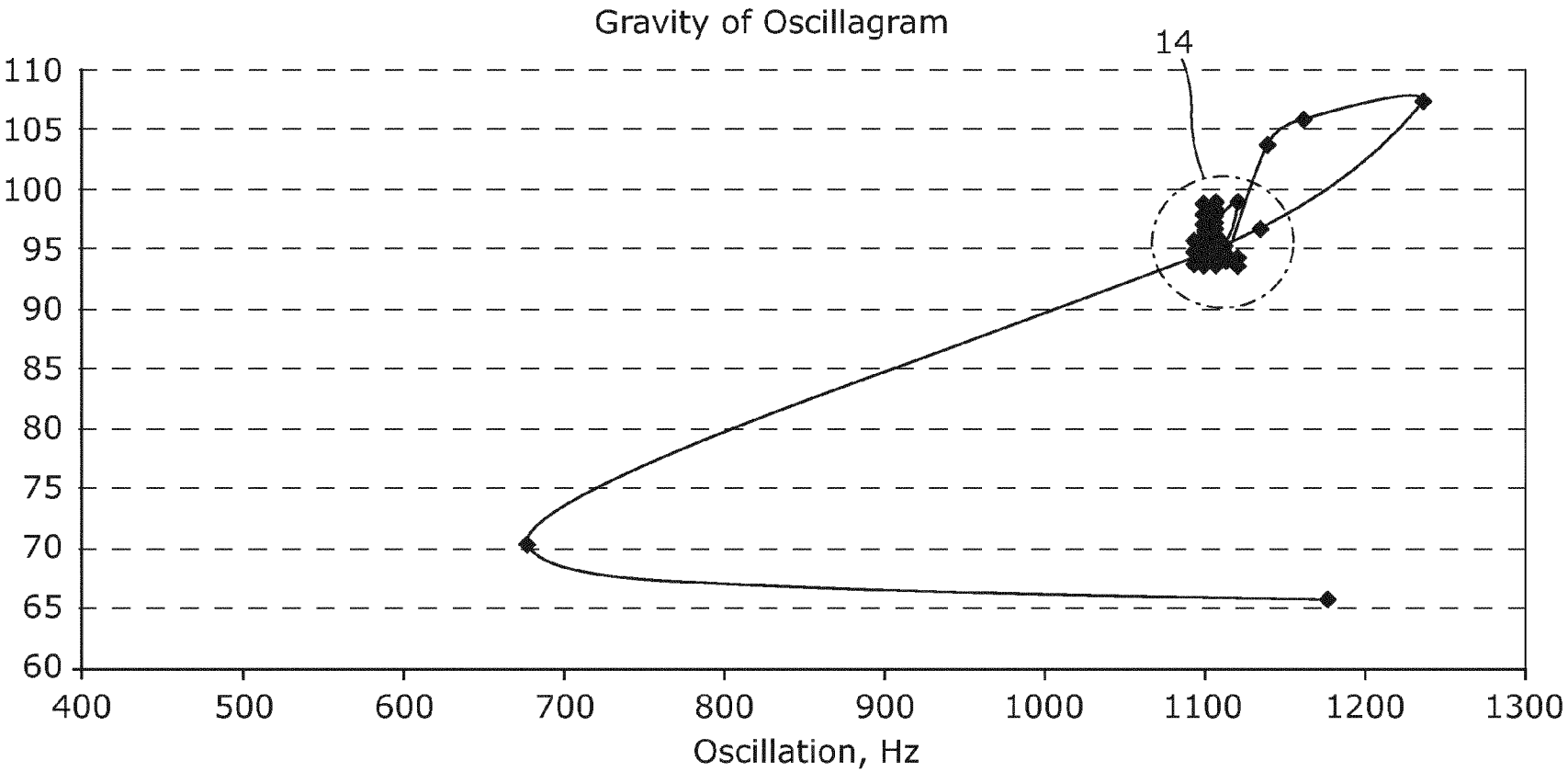
FIG. 4*b* shows a diagram of gravity of oscillation during a cutting operation.

FIG. 3 shows a cross-sectional view of the end of the wireline tool furthest away from the bit and closest to the wireline. The accelerometers 10, 11, 12 are arranged on the inner face 62 of the tool housing and are electrically connected to the processing unit 6. Using accelerometers allows for detection of vibrations in the tool housing remotely from the bit creating the vibration and it is thus possible to position the sensors in the end nearest the top of the well. Thus, the measurements performed in this remote end can be used for detecting when the cutting operation has resulted in a casing being cut through, as shown in FIG. 4*b*. This is due to the fact that accelerometers are much better at detecting small variations than microphones, and using accelerometers thus provides usable and reliable results which can easily be implemented in existing tools.

To compare the real-time frequency spectrum with the reference frequency spectrum, a centre of gravity of the oscillation is calculated for each spectrum, and the two centres of gravity are subsequently compared. The calculation of a centre of gravity is illustrated in FIG. 4*a* in which the sum of the areas of peaks in the frequency spectrum which are above a certain value 78 is calculated as a weighted average for determination of the centre of gravity of oscillation. The calculation of the centre of gravity of the oscillation of the reference frequency spectrum results in the data sets plotted into the circle 14 of FIG. 4*b*. The circle illustrates the maximum and minimum intervals in which the operation is still running according to plan. In FIG. 4*b*, the centre of gravity of the area of peaks in the real-time frequency spectrum, which area is above the certain value is plotted, and as can be seen, when the bit cutting is running according to plan, the centre of gravity of the oscillation is within the circle at 90-100 at a frequency around 1120 Hz. When the bit starts to cut through the casing wall, the centre of gravity increases and then decreases to below 70. This is due to the fact that a casing partly cut through has a substantially different Eigen frequency than an uncut casing, which is detectable by the accelerometer arranged remotely from the bit. The reference frequency is determined so as to be able to determine a discrepancy between the reference and the real-time frequency spectrum. When the discrepancy is above a certain level and the data set extends beyond the circle, the bit is about to break through the casing. The certain value may be set at an amplitude of more than 40, preferably more than 50, and even more preferably more than 60. The ordinate axis refers to the centre of gravity of the area of peaks in the real-time frequency spectrum, which area is above the certain value. The ordinate axis is thus purely a "theoretical" calculated number.

Figure 5:
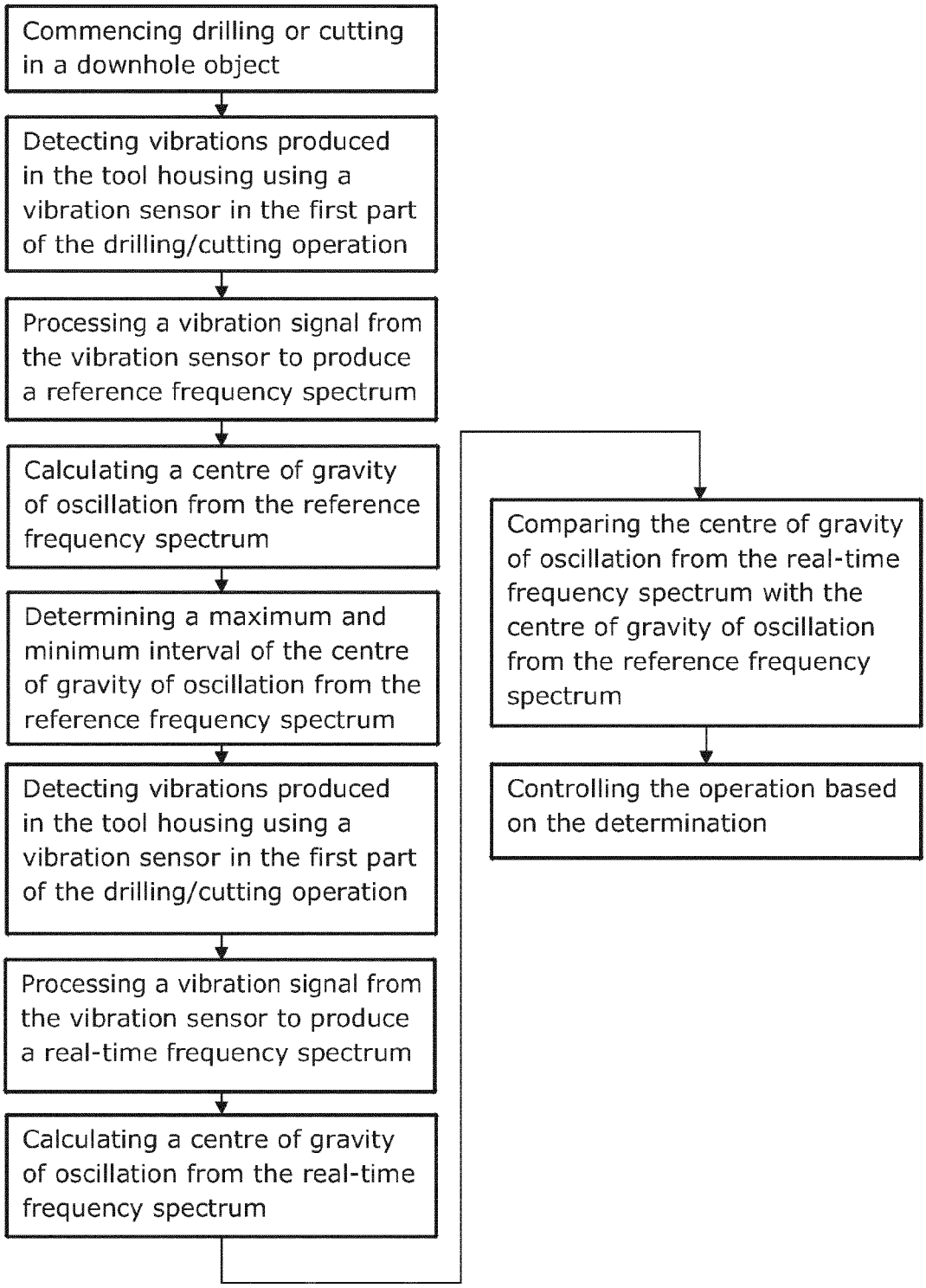
FIG. 5 shows a flowchart of another embodiment of the method for controlling a drilling or cutting operation.

When using the method of calculating the centre of gravity of oscillation as shown in FIG. 5, the calculation of the centre of gravity of oscillation of the reference frequency spectrum is conducted before a real-time frequency spectrum is detected. The minimum and maximum intervals are determined as illustrated by the circle 14 in FIG. 4*b*. The centre of gravity of the real-time frequency spectrum is then calculated and compared with the centre of gravity of the reference frequency spectrum, and it is determined if the real-time frequency spectrum is within or outside the minimum and maximum intervals. If the real-time spectrum is evaluated to be outside the interval and the centre of gravity data set is higher than the interval, the operation is continued, as the casing may be about to be cut through according to plan. If the next data set of the centre of gravity of the real-time frequency spectrum is positioned on the curve illustrated in FIG. 4*b*, the operation runs according to plan. If the next data set of the centre of gravity of the real-time frequency spectrum is positioned substantially outside the curve, the operation is stopped or the operation parameters are changed.

As illustrated in the diagram of FIG. 5, the tool is submerged into the well, and the cutting or drilling operation is initiated. The vibrations generated during this cutting or drilling operation are transferred through the tool housing and to be detected by a vibration sensor. Based on the vibrations detected during the first operation, a vibration signal and a reference frequency spectrum are produced. Subsequently, a centre of gravity of the reference frequency spectrum is calculated, and the minimum and maximum of the centre of gravity are determined, represented by the circle 14 of FIG. 4*b*. Then, the detected vibrations are continued and a real-time frequency spectrum is produced, and the centre of gravity of the real-time frequency spectrum is calculated and compared with the centre of gravity of the reference frequency spectrum. If the centre of gravity of the real-time frequency spectrum is not within the calculated minimum and maximum interval, the operation is controlled accordingly.

As illustrated in the diagram of FIG. 1, the operation may also be controlled without calculating the centre of gravity of oscillation. After initiating the cutting or drilling, the vibrations produced during the operation are detected by a vibration sensor in contact with the tool housing. Based on the vibrations detected during the first operation, a vibration signal and a reference frequency spectrum are produced. Then, the detected vibrations are continued and a real-time frequency spectrum is produced and compared with the reference frequency spectrum. If there is a discrepancy between the real-time frequency spectrum and the reference frequency spectrum, the operation is controlled accordingly.

Both the wireline drilling tool and the wireline cutting tool further comprise a processing unit 6 for processing vibration signals recorded by the vibration sensors and a control unit 7 for controlling the drilling tool or the cutting tool based on an evaluation of the recorded vibrations.

By drill bit or cutting bit is meant any kind of suitable tool cutting or drilling through the casing wall and thus dividing the casing into two parts, such as a cutting blade, saw etc.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A method for controlling a drilling or cutting operation performed by a wireline tool downhole, comprising the steps of:

commencing a drilling or cutting operation in a downhole object, such as a casing or valve, detecting vibrations in a tool housing produced during the drilling or cutting operation in the downhole object using a vibration sensor being an accelerometer arranged on the tool housing, processing a vibration signal from the vibration sensor to produce a reference frequency spectrum comprising actual measurements taken during a first part of the drilling or cutting operation, processing a vibration signal from the vibration sensor to produce a real-time frequency spectrum comprising actual measurements taken during a second part of the drilling or cutting operation, comparing the real-time frequency spectrum to the reference frequency spectrum, calculating and detecting a completion or failure of the operation, such as a completion in which the casing has been cut into two casing sections or a failure in which the bit is stuck, based on the comparison of the real-time frequency spectrum and the reference frequency spectrum, and controlling the operation to terminate the operation when completion or failure of the operation has been detected, wherein the step of calculating and detecting a completion of the operation comprises a step of calculating a centre of gravity of oscillation of an area of peaks in the frequency spectrum, which area is above a certain value and comparing that centre of gravity with a centre of gravity of an area of peaks in the reference frequency spectrum, which area is above the same certain value to determine a discrepancy between the two centres of gravity, and wherein the step of controlling the operation is based on the centre of gravity comparison.

2. A method according to claim 1, wherein the step of processing a vibration signal from the vibration sensor to produce the reference frequency spectrum is performed in the first part of the drilling or cutting operation when a start-up phase has ended.

3. A method according to claim 1, further comprising the step of terminating the drilling or cutting operation in the downhole object if the discrepancy is above a predetermined threshold value.

4. A method according to claim 1, further comprising the step of inferring that the downhole object is being drilled or cut when the discrepancy between the reference frequency spectrum and the real-time frequency spectrum is above or below a predetermined threshold value.

5. A method according to claim 1, further comprising a step of sending a signal uphole that the operation has been performed with an acceptable discrepancy between the real-time frequency spectrum and the reference frequency spectrum.

6. A method according to claim 1, further comprising the step of controlling the drill bit rotary speed and weight on bit based on the discrepancy between a reference frequency spectrum and the real-time frequency spectrum.

7. A method according to claim 1, further comprising the step of inferring excessive drill bit wear based on the discrepancy between a reference frequency spectrum and the real-time frequency spectrum.

8. A method according to claim 1, further comprising the step of detecting a change in the discrepancy between the reference frequency spectrum and a real-time frequency spectrum indicative of the casing wall having been completely drilled or cut through.

9. A wireline tool for performing a drilling or cutting operation downhole and carrying out the method according to claim 1, comprising:

a tool housing having an inner face, a drill bit or cutting bit, a means for advancing the drill bit or cutting bit, a rotation means for rotating the drill bit or cutting bit, and one or more vibration sensors, wherein the one or more vibration sensors is/are accelerometer(s) arranged to contact(s) the inner face of the tool casing and adapted to detect vibrations in the tool housing transmitting vibrations produced during operation of the wireline drilling or cutting tool to the one or more sensors, and wherein the wireline tool further comprises a processing unit for processing a vibration signal from the vibration sensor to produce a real-time frequency spectrum, and for comparing the frequency spectrum to a reference frequency spectrum.

10. A wireline tool according to claim 9, wherein the one or more vibration sensors is/are arranged in an end of the tool furthest away from the drill bit car cutting bit.

11. A wireline tool according to claim 9, wherein the vibration sensors are arranged along a circumference of the inner face.

12. A wireline tool according to claim 9, wherein the tool comprises an array of vibration sensors arranged along the inner face.

13. A wireline tool according to claim 9, wherein a means for advancing the drill bit or cutting bit is a downhole tractor.

* * * * *